US011566522B2

(12) United States Patent
Burger et al.

(10) Patent No.: US 11,566,522 B2
(45) Date of Patent: Jan. 31, 2023

(54) DEVICE AND METHOD FOR CONTINUOUSLY DRIVING A TUNNEL

(71) Applicant: HERRENKNECHT AKTIENGESELLSCHAFT, Schwanau (DE)

(72) Inventors: Werner Burger, Schwanau (DE); Thomas Joseph Edelmann, Stephanshart (DE)

(73) Assignee: HERRENKNECHT AKTIENGESELLSCHAFT, Schwanau (DE)

( * ) Notice: Subject to any disclaimer, the term of this patent is extended or adjusted under 35 U.S.C. 154(b) by 37 days.

(21) Appl. No.: 16/964,743

(22) PCT Filed: Feb. 1, 2019

(86) PCT No.: PCT/EP2019/052461
§ 371 (c)(1),
(2) Date: Aug. 17, 2020

(87) PCT Pub. No.: WO2019/149867
PCT Pub. Date: Aug. 8, 2019

(65) Prior Publication Data

US 2021/0032991 A1 Feb. 4, 2021

(30) Foreign Application Priority Data

Feb. 2, 2018 (DE) ..... 10 2018 102 330.8

(51) Int. Cl.
*E21D 9/087* (2006.01)
*E21D 9/11* (2006.01)
(Continued)

(52) U.S. Cl.
CPC ..... *E21D 9/0873* (2016.01); *E21D 9/0607* (2013.01); *E21D 9/0621* (2013.01);
(Continued)

(58) Field of Classification Search
CPC ... E21D 9/0873; E21D 9/0607; E21D 9/0621; E21D 9/0692; E21D 9/093; E21D 9/003;
(Continued)

(56) References Cited

U.S. PATENT DOCUMENTS 4,548,443 A * 10/1985 Turner ..... E21D 9/1093 299/31
4,637,657 A * 1/1987 Snyder ..... E21D 9/112 299/31
4,904,115 A * 2/1990 Lebreton ..... E21D 9/093 299/1.3

FOREIGN PATENT DOCUMENTS

CN 1800583 A * 7/2006
CN 101713292 A * 5/2010
(Continued)

OTHER PUBLICATIONS

English language machine translation of Tobishima Construct Co., JP4-206054, published Jan. 7, 2009 (12 pages) (Year: 2009).*
International Search Report dated May 6, 2019.

*Primary Examiner* — Janine M Kreck
*Assistant Examiner* — Michael A Goodwin
(74) *Attorney, Agent, or Firm* — Faegre Drinker Biddle & Reath LLP

(57) ABSTRACT

In a device and a method for continuously driving a tunnel along a desired setpoint trajectory there is provision to influence pressing forces which are applied to installed tubbing segments by compactors using a control circuit, wherein, during the driving and during the installation of tubbing rings, an actual trajectory of the device remains in a region which is permissible for maintaining the desired set point trajectory.

6 Claims, 8 Drawing Sheets

(51) Int. Cl.

| | |
|---|---|
| ***E21D 9/06*** | (2006.01) |
| ***E21D 9/093*** | (2006.01) |
| ***E21D 9/00*** | (2006.01) |
| *E21D 11/40* | (2006.01) |

(52) U.S. Cl.
CPC ..... *E21D 9/093* (2016.01); *E21D 9/11* (2013.01); *E21D 9/112* (2013.01); *E21D 9/003* (2013.01); *E21D 11/403* (2013.01)

(58) Field of Classification Search
CPC ..... E21D 9/005; E21D 9/06; E21D 9/1086; E21D 9/1093; E21D 9/11; E21D 9/112; E21D 11/403
See application file for complete search history.

(56) References Cited

FOREIGN PATENT DOCUMENTS

| | | | | | |
|---|---|---|---|---|---|
| CN | 104632238 | A | * | 5/2015 | |
| CN | 104727823 | A | | 6/2015 | |
| CN | 204552748 | U | | 8/2015 | |
| CN | 105518253 | A | | 4/2016 | |
| CN | 105736007 | A | * | 7/2016 | |
| CN | 206608174 | U | | 11/2017 | |
| DE | 3231544 | A1 | | 3/1984 | |
| EP | 0 974 732 | | | 1/2000 | |
| JP | 02047496 | A | * | 2/1990 | ..... E21D 9/0873 |
| JP | H0492094 | A | | 3/1992 | |
| JP | HO4-92094 | | | 3/1992 | |
| JP | 4-206054 | | | 1/2009 | |
| JP | 4206054 | B2 | | 1/2009 | |

* cited by examiner

DEVICE AND METHOD FOR CONTINUOUSLY DRIVING A TUNNEL

CROSS-REFERENCE TO RELATED APPLICATION

This application is a U.S. National Phase Patent Application based on International Application Serial No. PCT/EP2019/052461, filed Feb. 1, 2019, the entire disclosure of which is hereby explicitly incorporated by reference herein.

FIELD

The present invention relates to a device for continuously driving a tunnel.

BACKGROUND

One known device and a method for continuously driving a tunnel are known from EP 0 974 732 A1. In the case of this device for continuously driving a tunnel along a predefined setpoint trajectory, there is a cutting wheel for working a tunnel face, while compactors working in an axial direction are provided for lining a tunnel wall with tubbing segments, which compactors are held by a compactor bearing in the axial direction that is also set up for supporting the cutting wheel and equipped with pressing forces on the side of the compactor bearing facing away from the cutting wheel for pressing on tubbing segments. Pressing shields that can be moved back and forth are disposed on a center shield for tensioning during tubbing segment lining.

SUMMARY

The present invention relates to a device for continuously driving a tunnel. along a predefined setpoint trajectory with a cutting wheel for working a tunnel face, with a number of compactors working in an axial direction and arranged on the side of the cutting wheel facing away from a tunnel face, which compactors are held by a compactor bearing, against which the cutting wheel is supported in the axial direction, and are equipped with pressing forces on the side of the compactor bearing facing away from the cutting wheel for pressing on tubbing segments.

The invention also relates to a method for continuously driving a tunnel.

The problem addressed by the invention is specifying a device of the type cited at the outset and a method for continuously driving a tunnel, in which, when placing tubbing segments with retracting of compactors working axially without a radial support, a continuous driving of a tunnel along a predefined setpoint trajectory continues to be guaranteed.

This problem is solved by a device of the type cited at the outset according to the invention in that at least several compactors are attached to a converter module for measuring a pressure value associated with a pressing force exerted on a tubbing segment, that there is a central unit with a central control module, to which the converter modules are attached for transmitting the pressure values, that the central unit moreover has a navigation measuring module, a pressing force correction module and a navigation prediction module, which interact in such a way that an initial trajectory prediction can be determined about a future trajectory with the navigation prediction module in the case of at least one given distribution of the pressing forces exerted by the compactors, wherein, in the case of a deviation of the future trajectory or an actual trajectory from the setpoint trajectory predefined by the navigation measuring module via the pressing force correction module, the pressing forces exerted by the compactors for stabilizing an actual force focal point resulting from the exerted pressing forces can be adjusted such that the deviation of the future trajectory from the setpoint trajectory is reduced as compared to the initial trajectory prediction.

This problem is solved with a method for the continuous driving of a tunnel along a predefined setpoint trajectory according to the invention with the use of a device according the invention and with a continuous lining of a tunnel with tubbing segments, in which in a pressing force modifying step, the pressing force correction module determines, in the case of retracted compactors, determines new pressing forces for compactors that continue to be pressed on tubbing segments in such a way that the deviation of the future trajectory determined by the trajectory prediction from the setpoint trajectory as compared to the initial trajectory prediction after retracting the compactors without the exertion of pressing forces by these compactors is reduced, in a tubbing segment placement step, firstly the, or each, compactor pressed on an installed tubbing segment is retracted from the installed tubbing segment to free an installation space for a tubbing segment to be installed and then the driving is continued with the new pressing forces and the to-be-installed tubbing segment is installed, until the retracted compactors are again pressed on the newly installed tubbing segments and new pressing forces are determined by means of the pressing force correction module as well as applied in order to maintain the setpoint trajectory during the installation of the next tubbing segment for the compactors.

Due to the fact that, according to the invention, an interaction of the pressing force correction module and the navigation prediction module through the lining with tubbing segments enables locally strongly varying pressing forces to be thereby compensated for, that, in the case of the installation of a tubbing segment through a new determination of pressing forces exerted by compactors that continue to be active, a compensation with a stabilization of an actual force focal point is established, allows the predefined setpoint trajectory to be maintained largely free of deviations during a continued continuous tunnel driving.

In the case of one expedient embodiment of a device according to the invention, the compactors are held in a compactor bearing ring for a secure absorption of abutment forces, which compactor bearing ring is disposed in the region of a center shield.

For a uniform application of force, it is expedient in the case of a device according to the invention that the compactors are uniformly spaced apart from each other in the circumferential direction.

For control-related reasons, it is expedient in the case of a device according to the invention that the compactors interact two by two in compactor pairs.

For an effective control, it is expedient in the case of a device according to the invention that to determine the trajectory prediction with the navigation prediction module, the deviation of the actual force focal point of all pressing forces from a setpoint force focal point can be determined and that the deviation of the actual force focal point from the setpoint force focal point forms a control variable of a control circuit comprising the pressing force correction module, the navigation prediction module and the central control module.

For an effective control, it is likewise expedient in the case of a device according to the invention that converter modules processing pressure values and path values of the compactors are attached to the central control module via a pressure processing module.

In the case of one embodiment of the method according to the invention, it is expedient with respect to as little load change as possible, that the tubbing segment placement steps are carried out successively on tubbing segments that are adjacent in the circumferential direction.

Another embodiment of a method according to the invention provides for an efficient driving in that the determination of the new pressing forces during the installation of tubbing segments for the duration of an installation of a tubbing segment takes place via a control of the location of an actual force focal point from the applied pressing forces as compared to a setpoint force focal point.

In one form thereof, the present invention provides a device for driving and lining a tunnel along a predefined setpoint trajectory with a cutting wheel for working a tunnel face, with a number of compactors working in an axial direction and arranged on the side of the cutting wheel facing away from a tunnel face, which compactors are held by a compactor bearing, against which the cutting wheel is supported in the axial direction, and are equipped with pressing forces on the side of the compactor bearing facing away from the cutting wheel for pressing on tubbing segments, wherein at least several compactors are attached to a converter module for measuring a pressure value associated with a pressing force exerted on a tubbing segment, wherein there is a central unit with a central control module, to which the converter modules are attached for transmitting the pressure values, that the central unit moreover has a navigation measuring module, and a pressing force correction module, and wherein, in the case of a deviation of the future trajectory or an actual trajectory from the setpoint trajectory predefined by the navigation measuring module via the pressing force correction module, the pressing forces exerted by the compactors for stabilizing an actual force focal point resulting from the exerted pressing forces can be adjusted such that the deviation of the future trajectory from the setpoint trajectory is reduced as compared to the initial trajectory prediction, characterized in that a navigation prediction module is present, with which, in the case of at least one given distribution of the pressing forces exerted by the compactors during the installation of tubbing segments that are adjacent in the circumferential direction for a continuous driving and lining until a tubbing segment ring is closed, an initial trajectory prediction can be determined about a future trajectory, that to determine the trajectory prediction with the navigation prediction module, the deviation of the actual force focal point of all pressing forces from a setpoint force focal point can be determined and that the deviation of the actual force focal point from the setpoint force focal point forms a control variable of a control circuit comprising the pressing force correction module, the navigation prediction module and the central control module, wherein the calculation of the new pressing forces takes place in advance for a time period from the beginning of the installation of a tubbing segment until the conclusion of the installation of said tubbing segment and therefore until the beginning of the installation of the next tubbing segment so that the trajectory prediction determined by the navigation prediction module takes place by stabilizing the actual force focal point at least to an approximation of the actual trajectory with the setpoint trajectory for the time period of the installation of new tubbing segments.

In another form thereof, the present invention provides a method for continuously driving a tunnel along a predefined setpoint trajectory with the use of the foregoing device and with a continuous lining of a tunnel with tubbing segments, in which in a pressing force modifying step, the pressing force correction module determines new pressing forces for compactors that continue to be pressed on tubbing segments in such a way that the deviation of the future trajectory determined by the trajectory prediction from the setpoint trajectory as compared to the initial trajectory prediction after retracting the compactors without the exertion of pressing forces by these compactors is reduced, in a tubbing segment placement step, firstly the, or each, compactor pressed on an installed tubbing segment is retracted from the installed tubbing segment to free an installation space for a tubbing segment to be installed and then the driving is continued with the new pressing forces and the to-be-installed tubbing segment is installed, until the retracted compactors are again pressed on the newly installed tubbing segments and new pressing forces are determined by means of the pressing force correction module as well as applied in order to maintain the setpoint trajectory during the installation of the next tubbing segment for the compactors.

DESCRIPTION OF THE DRAWINGS

Further expedient embodiments and advantages of the invention are yielded from the following description of an exemplary embodiment making reference to the figures in the drawing.

They show.

DETAILED DESCRIPTION

Figure 1:
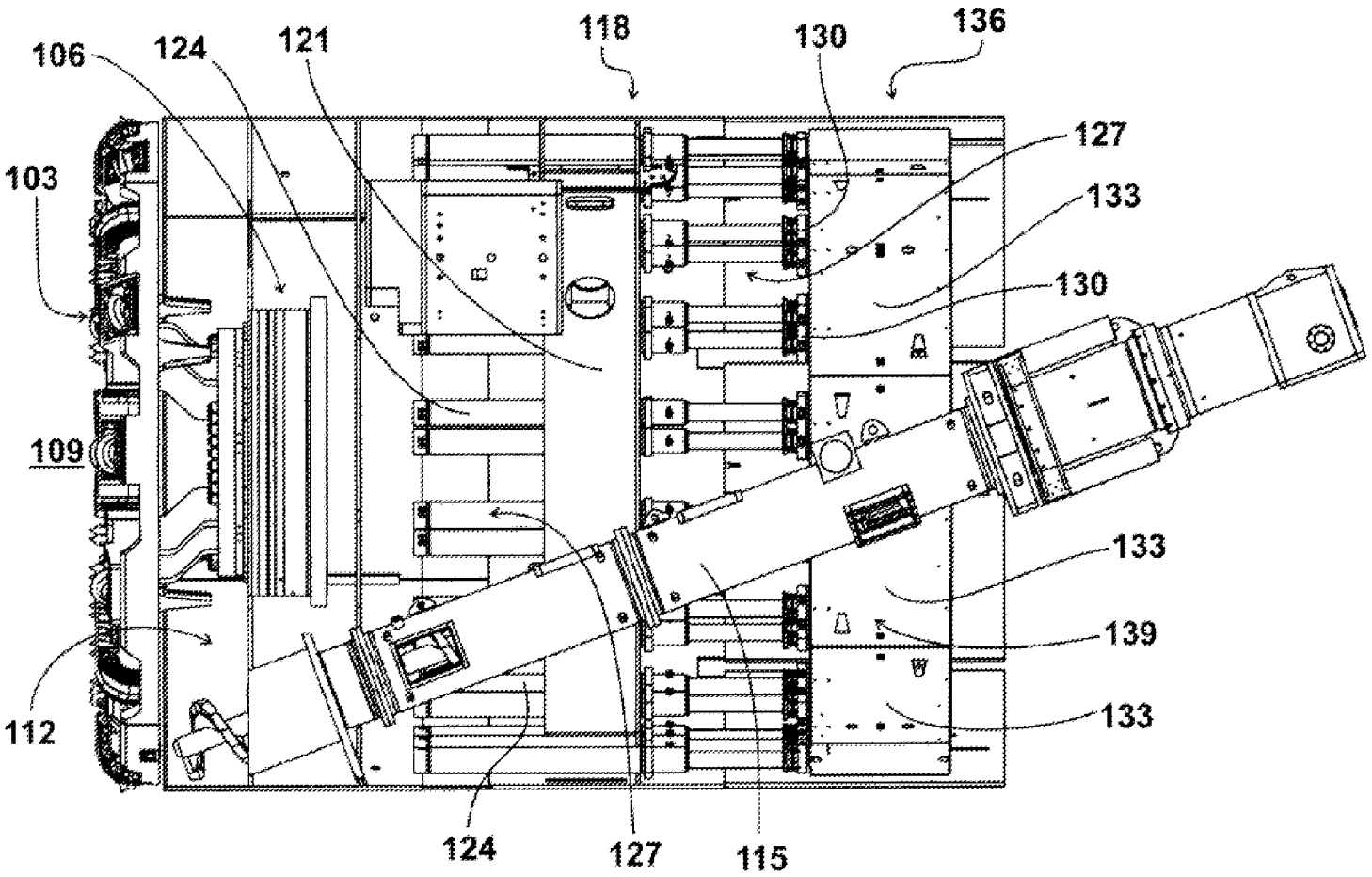
FIG. 1—A simplified partial section in a lateral view of an exemplary embodiment of a device for the continuous driving of a tunnel according to the invention with a number of compactors working in an axial direction and held in compactor bearing.

FIG. 1 shows a partial section in a lateral view of an exemplary embodiment of a device for continuously driving a tunnel along a predefined setpoint trajectory according to the invention. The exemplary device according to FIG. 1 that is executed as a tunnel boring machine in a conventional design in terms of the essential mechanical, hydraulic and pneumatic components thereof has a cutting wheel 103, which can be rotated by a motorized drive unit 106 for working a tunnel face 109 located in front of the cutting wheel 103 in a driving direction. The excavated material (not shown in FIG. 1) cut by the cutting wheel 103 at the tunnel face 109 can be conveyed out of a working area 112, which is disposed at the rear side of the cutting wheel 103 in a driving direction, by means of a conveyance unit 115 configured as a screw conveyor in the exemplary embodiment according to FIG. 1 against the driving direction.

In the working direction at the rear side of the cutting wheel 103 and the drive unit 106, the exemplary embodiment according to FIG. 1 is equipped, in the region of a center shield 118 that is not necessarily radially clampable for the invention, with a compactor bearing designed as a compactor bearing ring 121, against which the cutting wheel 103 is supported in the axial direction and in which a number of hydraulically functioning compactors 124 are held. In the case of this exemplary embodiment, two compactors 124 are always coupled to form compactor pairs 127 and are connected in pairs with a pressure plate 130 disposed in the working direction at the rear side of the compactor bearing ring 121.

Present in the working direction at the rear side of the center shield 118 are tubbing segments 133 for a tunnel lining, which are installed during a continuous driving of the tunnel by means of the tunnel boring machine in the region of a shield tail 136 normally successively to the tubbing segment rings 139 that densely line the tunnel.

Figure 2:
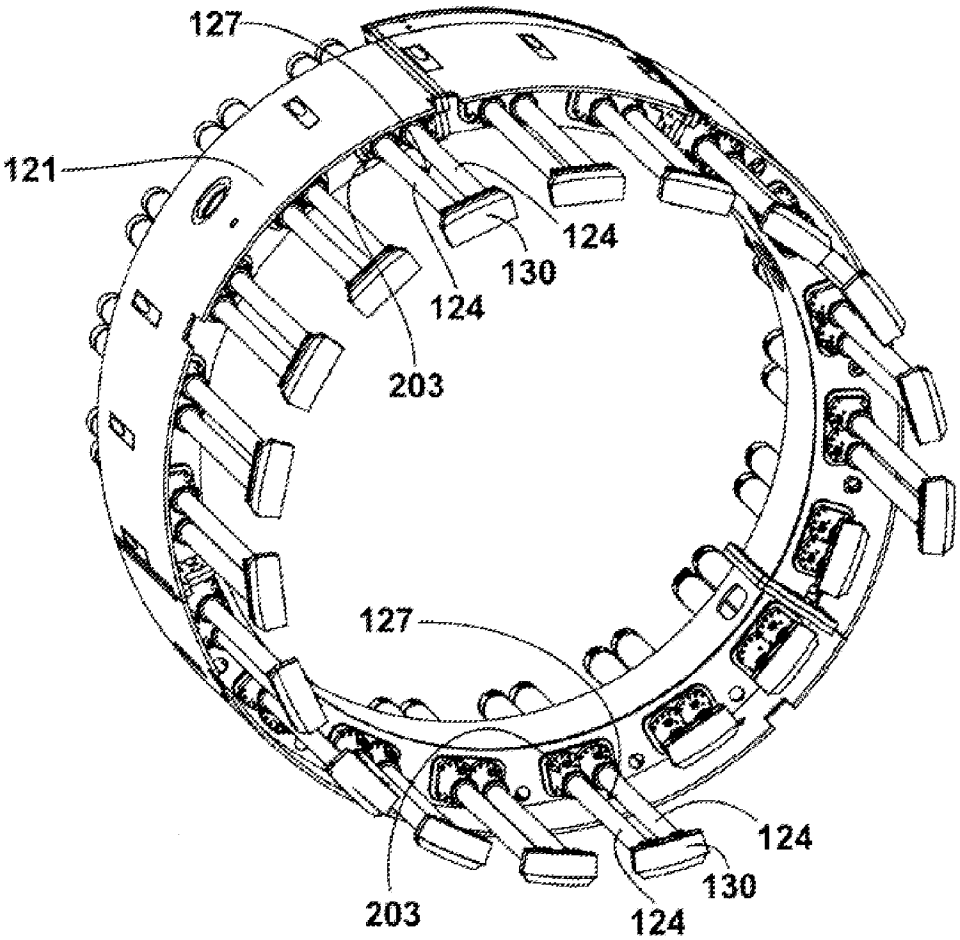
FIG. 2—A perspective view of the compactor bearing of the exemplary embodiment according to FIG. 1, which is configured as a compactor bearing ring and has compactors that are interconnected in pairs.

FIG. 2 shows a perspective view of the compactor bearing ring 121 of the exemplary embodiment according to FIG. 1 with the compactors 124 coupled to form compactor pairs 127. The distances of the compactors 124 that form a compactor pair 127 are the same for all compactor pairs 127, while the compactor pairs 127 are each arranged uniformly spaced apart in the circumferential direction of the compactor bearing ring 121. As a result, the pressure plates 130 likewise have a uniform distance from each other in the circumferential direction of the compactor bearing ring 121. As depicted in FIG. 2, the compactors 124 are positioned in compactor holders 203 that are permanently connected to the compactor bearing ring 121 and are therefore held firmly in the compactor bearing ring 121.

Figure 3:
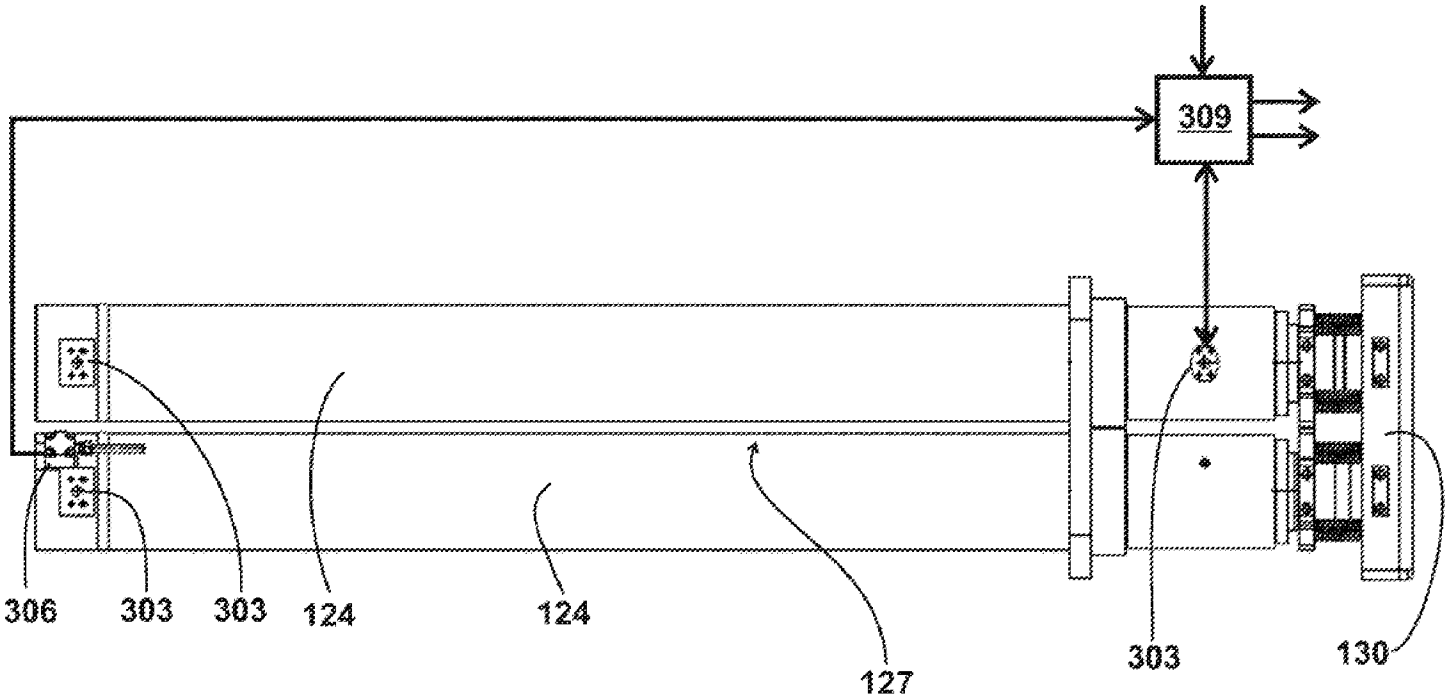
FIG. 3—A lateral view of a pair of interconnected compactors with a common pressure plate.

FIG. 3 shows a lateral view of a compactor pair 127 formed by two compactors 124 coupled together via a pressure plate 130. The compactors 124 are equipped with a hydraulic connection 303 and with a path sensor 306. The hydraulic connection 303 allows, controlled by a converter module 309, the pressing forces exerted by a compactor 124 on a tubbing segment 133 via the compactor plate 130 to be adjusted in a targeted manner via adjustable pressure values, as explained in more detail further below. The converter modules 309 of a compactor pair 127 are likewise connected to the path sensors 306 mentioned so that the position of the compactors 124 can also be ascertained with the converter modules 309 via path values and, as explained in more detail further below, can be processed further.

Figure 3A:
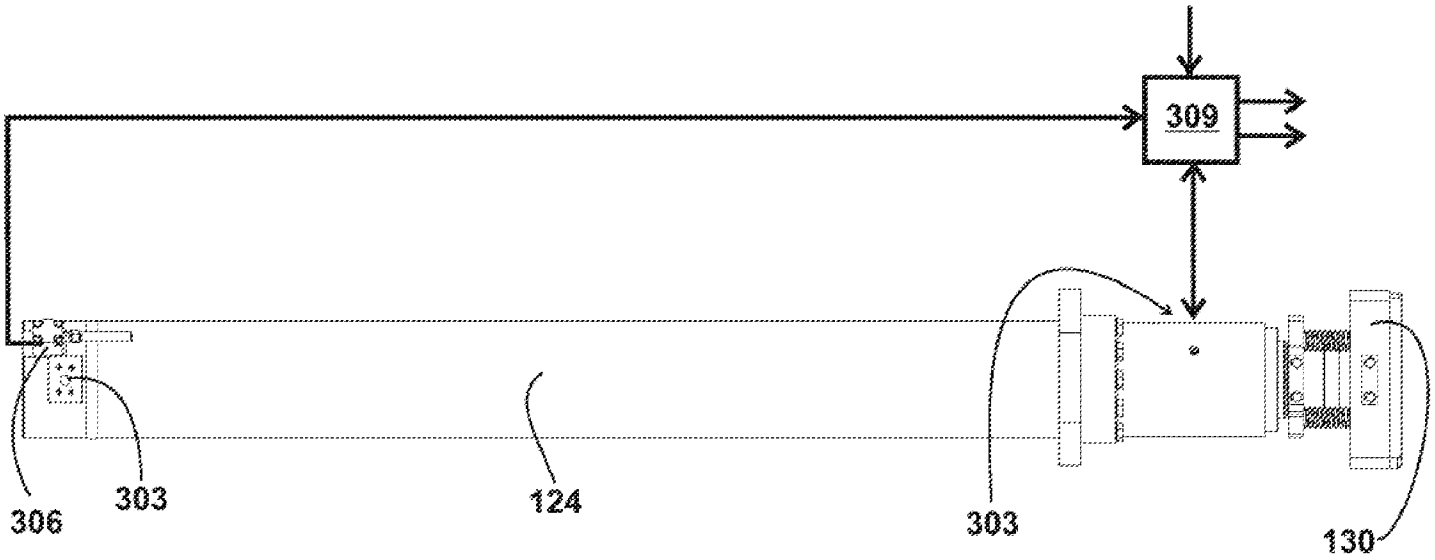
FIG. 3*a*—A lateral view of an individual compactor with a pressure plate.

FIG. 3*a* shows a lateral view corresponding to FIG. 3 of an individual compactor 124 with a pressure plate 130, which, in the case of a corresponding hydraulic dimensioning, can be used as a substitute for at least one compactor pair 127 and, as not explained in more detail further below, can be controlled like a compactor 124 of a compactor pair 127.

Figure 4:
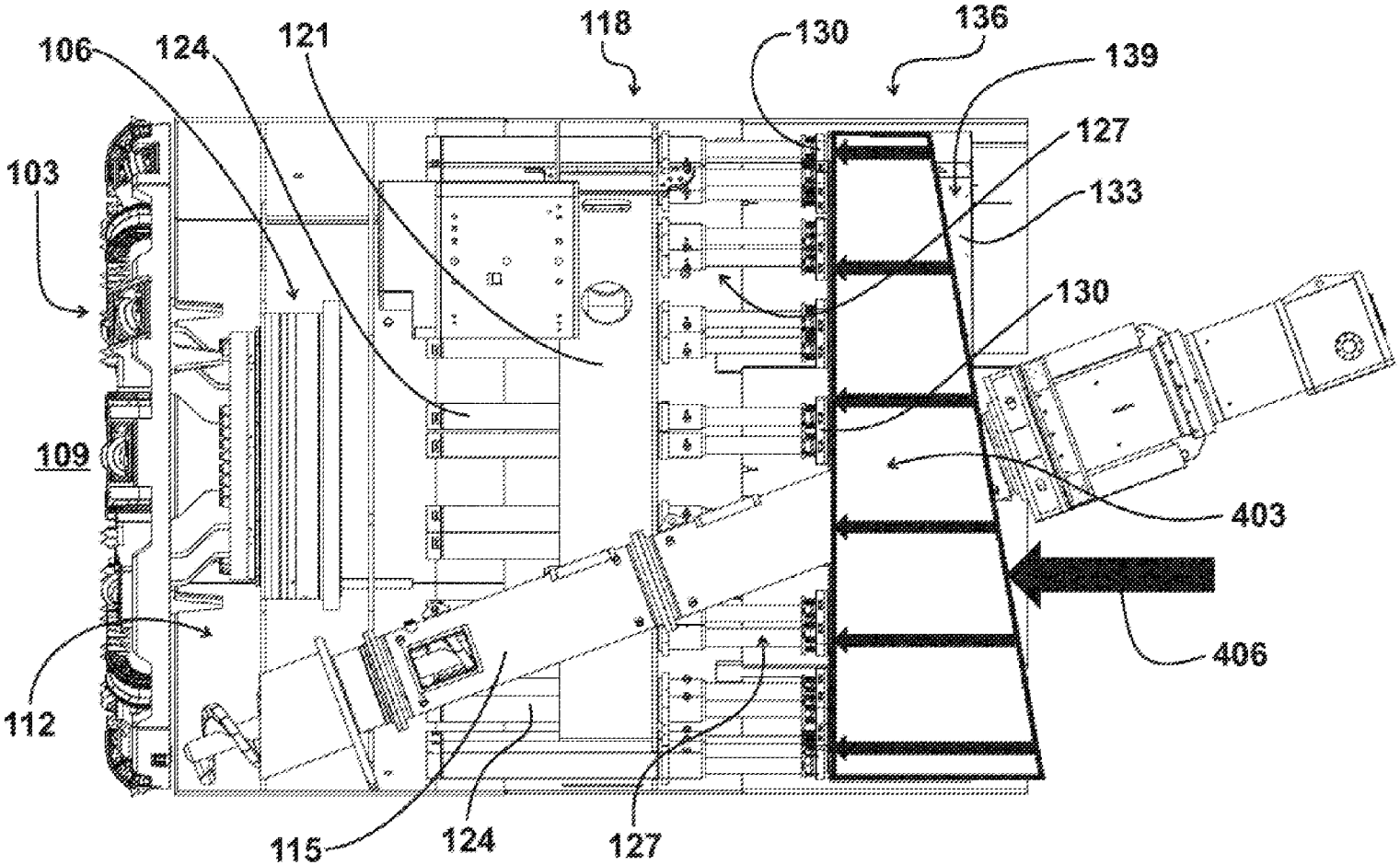
FIG. 4—A lateral view according to FIG. 1 of the illustration of the force conditions in a vertical longitudinal plane.

FIG. 4 shows a lateral view corresponding to FIG. 1 of the described exemplary embodiment. FIG. 4 symbolically shows in a vertical longitudinal plane, a force profile 403 with compensation forces increasing in the direction of gravity from the upper side to the lower side for compensating for the earth pressure in the region of the tunnel face 109. The actual force focal point 406, which is produced in the axial direction and depicted in FIG. 4 by an arrow, lies in the direction of gravity somewhat below the center shield axis of the tunnel boring machine. The compensation forces are thereby applied according to the invention exclusively or substantially by the pressing forces of the compactors 124, via a force flow chain involving the compactor bearing ring 121 in the axial direction between the compactors 124 and the cutting wheel 103, in order to position the cutting wheel 103 at a right angle to the setpoint trajectory for maintaining a predefined setpoint trajectory when driving the tunnel.

Figure 5:
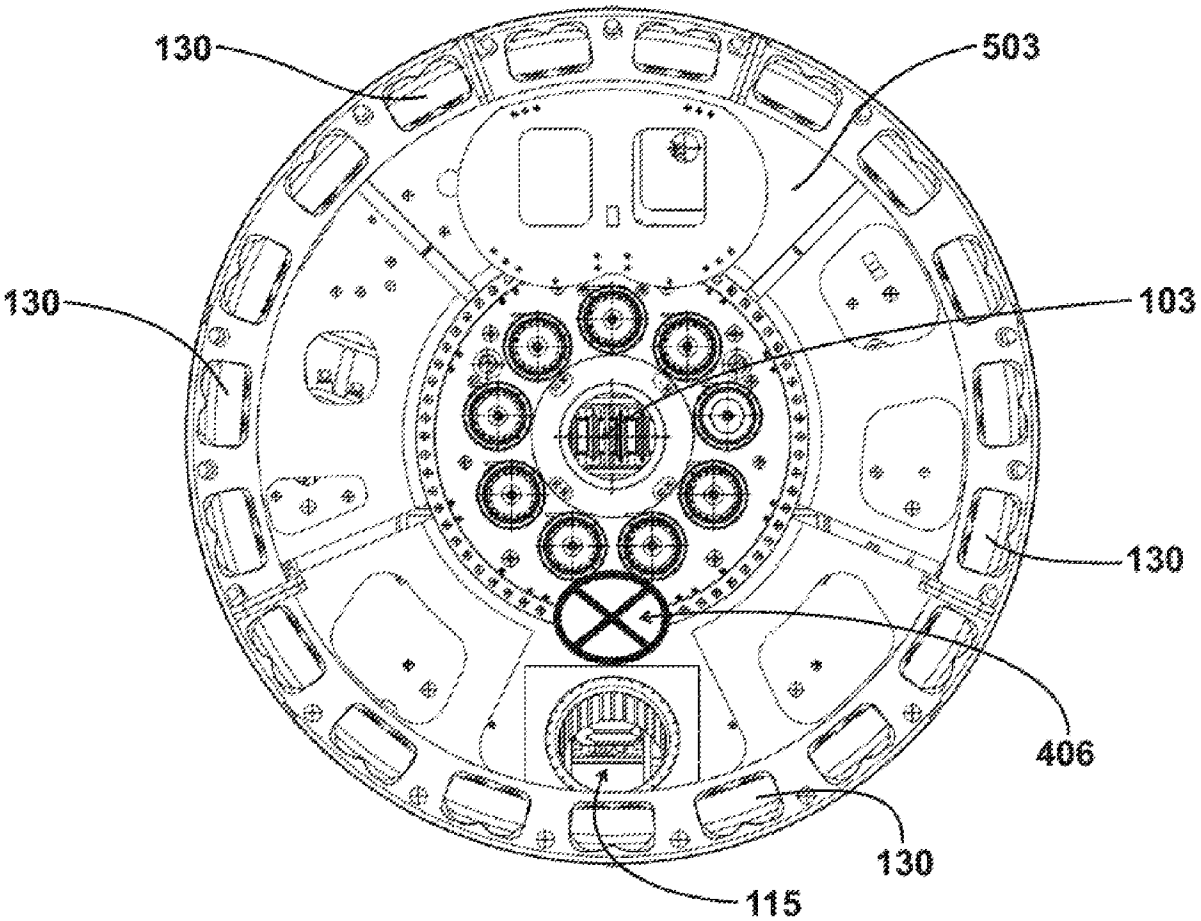
FIG. 5—A front view of the exemplary embodiment according to FIG. 1 with a depiction of a regular actual force focal point in a working situation, in which all compactors are exerting pressing forces on tubbing segments and a predefined setpoint trajectory is being maintained during continuous driving.

FIG. 5 shows a front view of the tunnel boring machine according to the described exemplary embodiment with a view of a pressure wall 503 arranged to the rear of the cutting wheel 103, which pressure wall limits the working area 112 in the working direction at the rear side. FIG. 5 shows that, in the case of maintaining the predefined setpoint trajectory, the actual force focal point 406, which is depicted symbolically in FIG. 5 by a circle with a cross inside, lies at the center vertical axis.

Figure 6:
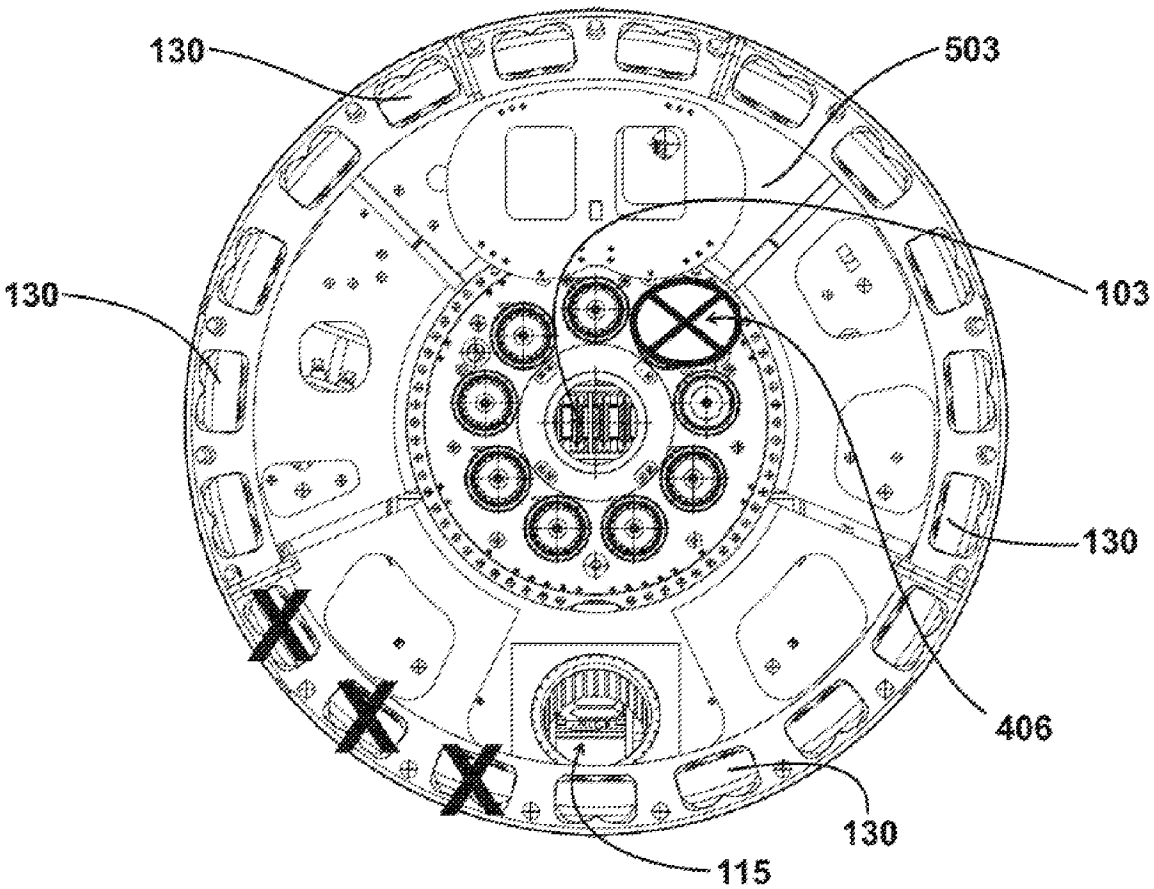
FIG. 6—A depiction in a front view according to FIG. 5 of how the actual force focal point displaces undesirably in the case of the removal of a number of adjacent compactors of tubbing segments without a correction of the pressing forces of the remaining compactors, and FIG. 7—A block diagram of the essential elements of an exemplary embodiment of the invention for a control circuit for adjusting the pressing forces for a continuous driving substantially along a predefined setpoint trajectory.

FIG. 6 shows a front view corresponding to the depiction in FIG. 5 of the tunnel boring machine with pressure plates 130, which are symbolically identified as removed from a tubbing segment 133 by three Xs, in order to free an installation space for a new to-be-installed tubbing segment 133. In the case of the otherwise unchanged pressing forces for the remaining pressure plates 130, the actual force focal point 406 is displaced as compared to the position according to FIG. 5 such that, in the case of a continuous driving, the predefined setpoint trajectory would be left without further measures.

Figure 7:
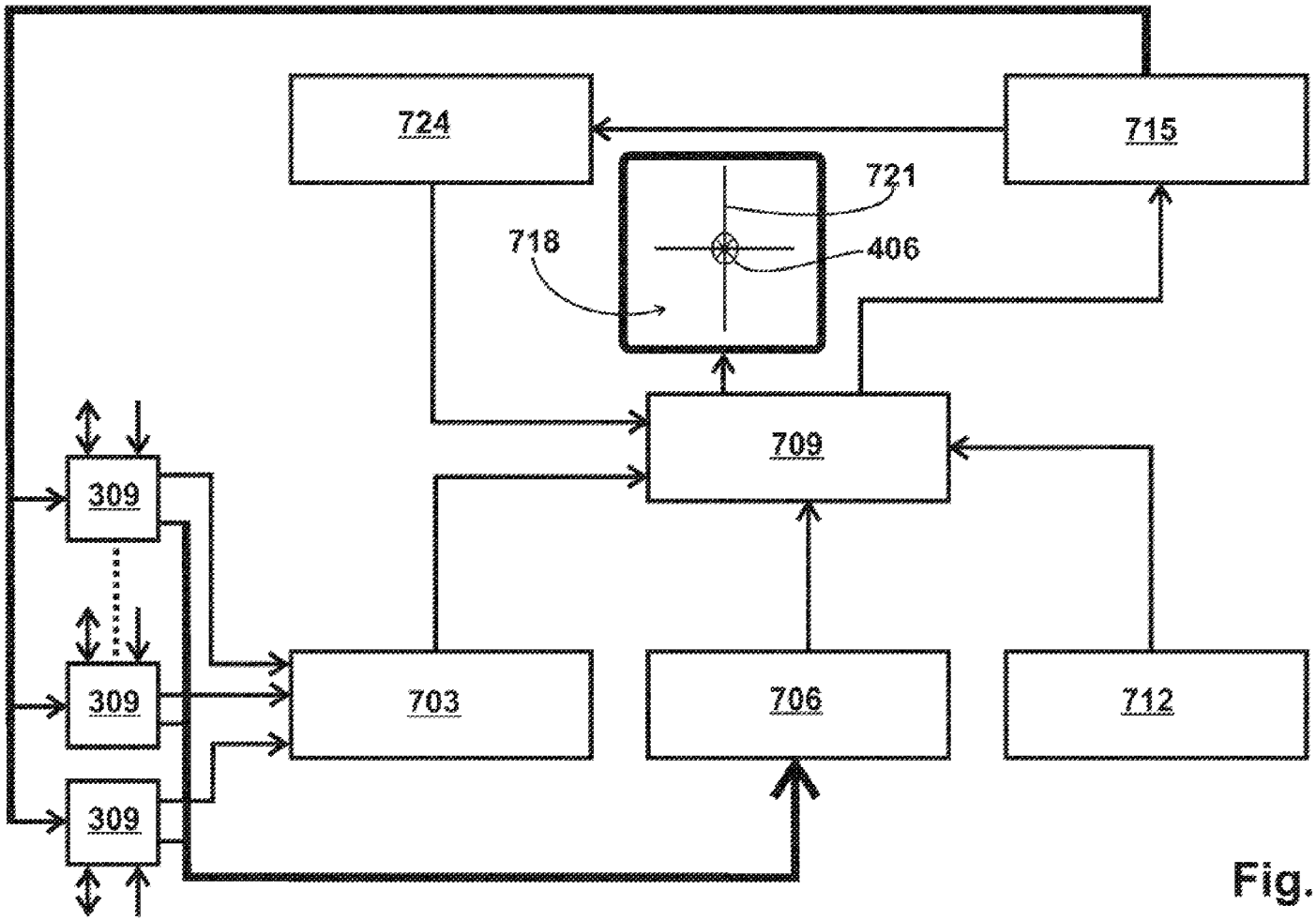

FIG. 7 shows in a block diagram the structure of a control for the described exemplary embodiment for continuously driving a tunnel along a predefined setpoint trajectory. The converter modules 309, which were already explained in conjunction with FIG. 3, are connected with their outputs for the pressure values to a pressure processing module 703, while the outputs for the path values can be supplied to a path processing module 706. The pressure processing module 703 and the path processing module 706 transmit their output data to a central control module 709 as an element of a central unit, to which a navigation measuring module 712 is also attached on the input side as a further element of the central unit.

The navigation measuring module 712 supplies to the central control module 709, among other things, a predefined setpoint trajectory to be maintained for the continuous driving of a tunnel, as well as, at certain times, for example only after the closing of a tubbing segment ring 139 or alternatively also at least once during the installation of tubbing segments 133, current navigation data associated with the actual positioning of tunnel boring machine.

A pressing force correction module 715 and a display module 718 are attached on the output side of the central control module 709 as further elements of the central unit. The display module 718, as depicted symbolically in FIG. 7, can advantageously display, in terms of a graphic reference system 721, the current location of the actual force focal point 406, which was explained in conjunction with FIG. 4 to FIG. 6.

The pressing force correction module 715 is in turn connected on the output side to a navigation prediction module 724 as a further element of the central unit, with which, in the case of given distributions of the pressing forces exerted by the compactors 124 or the compactor pairs 127, a trajectory prediction can be determined about a future trajectory for a certain time period, for example until the closing of a next tubbing segment ring 139 after the last determination of the actual positioning of the tunnel boring machine. The prediction data associated with the trajectory prediction can be returned by the navigation prediction module 724 to the central control module 709.

Furthermore, the pressing force correction module 715 is connected to inputs of the converter modules 309, in order to actuate the compactors 124 via same with pressure values for making available pressing forces predetermined by the pressing force correction module 715.

The modules of the arrangement explained in the forgoing interact according to a type of control circuit, as explained in the following.

As explained above, installing a new tubbing segment 133 requires certain compactors 124 to retract to free an installation space for the tubbing segment 133 to be installed so that the pressing forces thereof are equal to zero. In order to compensate for the inherently undesired displacement of the actual force focal point 406 that is thereby caused, as explained in conjunction with FIG. 6, new pressing forces are calculated with the pressing force correction module 715 and supplied to the navigation prediction module 724 in order to determine a trajectory prediction for a future trajectory. The calculation of the new pressing forces takes place for an efficient driving for example in advance for a time period from the beginning of the installation of a tubbing segment 133 until the conclusion of the installation of said tubbing segment 133 and therefore until the beginning of the installation of the next tubbing segment 133. However, it also takes place for shorter successive time periods especially for a highly precise driving or in the case of small-scale highly variable geologies. Based on the deviation of the future trajectory from the predefined setpoint trajectory through the displacement of the actual force focal point 406, which deviation is be expected by the elimination of the pressing forces, the pressing force correction module 715 determines new pressing forces in such a way that the trajectory prediction determined by the navigation prediction module 724 takes place by stabilizing the actual force focal point 406 at least to an approximation of the actual trajectory, expediently in the context of tolerable smaller deviations to a concurrence with the future trajectory, with the setpoint trajectory for the time period of installation of new tubbing segments 133.

When falling short of a predetermined limit value for a maximum deviation, the compactors 124 or compactor pairs 127 that continue to be applied to tubbing segments 133 are supplied with the newly calculated pressure values for making available correspondingly associated pressing forces. This takes place via the control of the location of the actual force focal point 406, for example for maintaining a location according to FIG. 5, also in the case of a migration occurring without control into an undesired location according to FIG. 6, as compared to a location of a setpoint force focal point, so that, in the case of a continuous driving, the predetermined setpoint trajectory is maintained also during the successive installation of tubbing segments 133 without the necessity for regularly querying the actual positioning of the tunnel boring machine, for example during the lining of a tubbing segment ring 139.

These adjustment steps for the pressing forces during a continuous driving are carried out in a relatively short clocked manner for a highly precise driving, expediently in relation to the driving rate, so that the predetermined setpoint trajectory can be maintained very exactly or maintained substantially at all times.

The invention claimed is:

1. A tunnel boring device for continuously driving and lining a tunnel along a predefined setpoint trajectory, comprising:

a cutting wheel for working a tunnel face;

a plurality of compactors coupled with a compactor bearing, the compactor bearing supporting the cutting wheel in an axial direction, wherein the compactors are disposed on a side of the compactor bearing facing away from the cutting wheel and are operable to press against tubbing segments lined adjacent one another about a circumferential direction when forming a ring of tubbing segments;

one or more converter modules coupled to at least some of the plurality of compactors, at least one of the one or more converter modules measuring pressure values associated with pressing forces exerted on the tubbing segments by the compactors; and a central unit comprising a central module, a navigation measuring module, a navigation prediction module, and a pressing force correction module, wherein:

the central module is in communication with each of the one or more converter modules and receives the pressure values from the one or more converter modules, the navigation measuring module determines any one of an actual position of the tunnel boring device, an actual trajectory of the tunnel boring device, and a setpoint trajectory for the tunnel boring device, the pressing force correction module determines an actual force focal point based upon at least one distribution of the pressing forces exerted by the compactors during an installation of the tubbing segments, the navigation prediction module determines an initial trajectory prediction for a future trajectory of a continuous driving and lining operation, the determination based upon a calculated deviation of the actual force focal point from a setpoint force focal point, and in the event that either the future trajectory or the actual trajectory of the continuous driving and lining operation deviates from the setpoint trajectory, the pressing forces exerted by the plurality of compactors are adjusted by the pressing force correction module to new pressing forces, the new pressing forces reducing the deviation between a calculated new trajectory prediction and the setpoint trajectory as compared to the initial trajectory prediction, the new pressing forces calculated in a time period prior to beginning the installation of a next circumferentially adjacent tubbing segment such that the actual trajectory of the driving and lining operation is stabilized during the installation of the next tubbing segment, the tunnel boring device operable to perform:

a pressing force modifying step, wherein:

the pressing force correction module calculates new pressing forces for one or more of the plurality of compactors, the one or more compactors of the plurality continuously pressing on one or more tubbing segments during the driving and lining operation, the calculation based upon a comparison of i) the deviation between the future trajectory of the initial trajectory prediction and the setpoint trajectory, and ii) the deviation between a calculated new future trajectory based upon a determined new trajectory prediction and the setpoint trajectory, and wherein the deviation of the new future trajectory and the setpoint trajectory is reduced as compared with the deviation between the future trajectory and the setpoint trajectory; and a tubbing segment placement step, wherein:

each compactor of the plurality pressed on a previously installed tubbing segment is retracted from the installed tubbing segment to free an installation space adjacent the previously installed tubbing segment, a new tubbing segment is installed in the installation space adjacent the previously installed tubbing segment, and the retracted compactors are pressed against the new tubbing segment based upon the calculated new pressing forces, the new pressing forces reducing the deviation between the actual trajectory of the tunnel boring device and the setpoint trajectory.

2. The device of claim 1, wherein at least one of the one or more converter modules are attached to the central control module via a pressure processing module, the converter modules processing pressure values and path values of the compactors.

3. The device of claim 1, wherein the compactors are held in the compactor bearing disposed proximate a center shield.

4. The device of claim 1, wherein the compactors are uniformly spaced apart from each other in the circumferential direction.

5. The device of claim 1, wherein the compactors are grouped in compactor pairs.

6. The device of claim 1, wherein:

the new pressing forces exerted by the compactors control the location of the actual force focal point of the pressing forces, the calculation of the new pressing forces is based upon the comparison of the actual force focal point to the setpoint force focal point, and the calculation of the new pressing forces occurs continuously throughout the driving and lining operation.

* * * * *